United States Patent [19]

Williams

[11] 3,989,203

[45] Nov. 2, 1976

[54] CREEL FOR PILE FABRICS HAVING FOLD-UP END ASSEMBLIES

[76] Inventor: Clarence Orville Williams, 3617 Sheffield Drive, Rocky Mount, N.C. 27801

[22] Filed: June 2, 1975

[21] Appl. No.: 582,984

[52] U.S. Cl. ..... 242/77.1; 242/62

[51] Int. Cl.[2] ..... B65H 75/02

[58] Field of Search ..... 242/62, 50, 77.1, 222, 242/55; 206/389, 407, 408

[56] References Cited

UNITED STATES PATENTS

| | | | |
|---|---|---|---|
| 2,922,516 | 1/1960 | Kessler | 242/77.1 |
| 3,189,172 | 6/1965 | Williams | 242/77.1 X |
| 3,231,080 | 1/1966 | Williams | 242/77.1 |
| 3,593,847 | 7/1971 | Kessler | 242/62 |

*Primary Examiner*—Edward J. McCarthy

[57] ABSTRACT

An improved creel useful for reeling and storing materials such as pile fabrics is formed from two spaced end assemblies connected by a tubular member. Each end assembly comprises a high-strength, relatively flat, box-like structure which is folded from a pre-scored cardboard blank. Suitable hook strips are mounted on the end assemblies to receive the convolutions of material. The folded-up box-like structure is adaptable for use as the end assembly for many types of boxes requiring a strong end.

16 Claims, 15 Drawing Figures

CREEL FOR PILE FABRICS HAVING FOLD-UP END ASSEMBLIES

BACKGROUND OF THE INVENTION

1. Field of the Invention

This invention relates generally to creels for storing and shipping pile fabrics and the like. More specifically, the invention relates to an improved end piece construction for such a creel.

2. Description of the Prior Art

The history of the prior art shows that the end construction for pile fabric creels usually takes the form of radially extending hook strips which are held in place and strengthened at their point of intersection. U.S. Pat. Nos. 3,189,172 and 2,976,987 show this general construction. Additional strength can be added to such a construction by the use of crossbars to join the ends of the hook strips as shown in U.S. Pat. Nos. 3,347,484 and 3,593,847.

The above all-metal constructions require riveting or welding of numerous parts. The shipping of such products takes up a great deal of space even if the end frames can be shipped partially disassembled as the frame in U.S. Pat. No. 2,976,987. Even though the expense of the materials, shipping and assembly of the all-metal creels of the prior art is considerable, the creels generally are discarded after one use. Thus, in this highly competitive market, there is an acute need for an end assembly which can be economically produced from inexpensive materials, shipped in a minimum space, easily assembled, and which is at least partially reusable.

SUMMARY OF THE INVENTION

According to the preferred embodiment of the present invention, the creel has two end assemblies held in opposed space relation by a tubular spreader arm, with each end assembly comprising a structural frame formed from a blank of scored, corrugated paperboard which is folded into an extremely strong unit of rectangular cross-section and to which are attached along the diagonals thereof four metal hook strips made from stamped metal.

More specifically, the blank includes a square, central front panel and four side panels which are hingedly connected along score lines to the front panel. Four triangular rear panels are hingedly connected to the side panels. The rear panels are connected to the front panel by closure flaps and tabs extending from the closure flaps and fitting into slots in the front panel. The seams between the back panels are taped to form a solid tension skin. The hook strips are attached to the front of the structural frame by inserting the fingers of the hook strips into slits in the tabs which protrude from the structural frame. The hook strips rest on top of the tabs and against the front surface of the structural frame.

For use as a creeling frame end assembly, the structural frame has a hole in the center for frictionally receiving a plug which extends from the frame and snap fits within a conventional tube-type spreader arm. The fold-up end assembly can be used as an end piece for any box requiring a strong end.

DESCRIPTION OF THE PREFERRED EMBODIMENT

Figure 1:
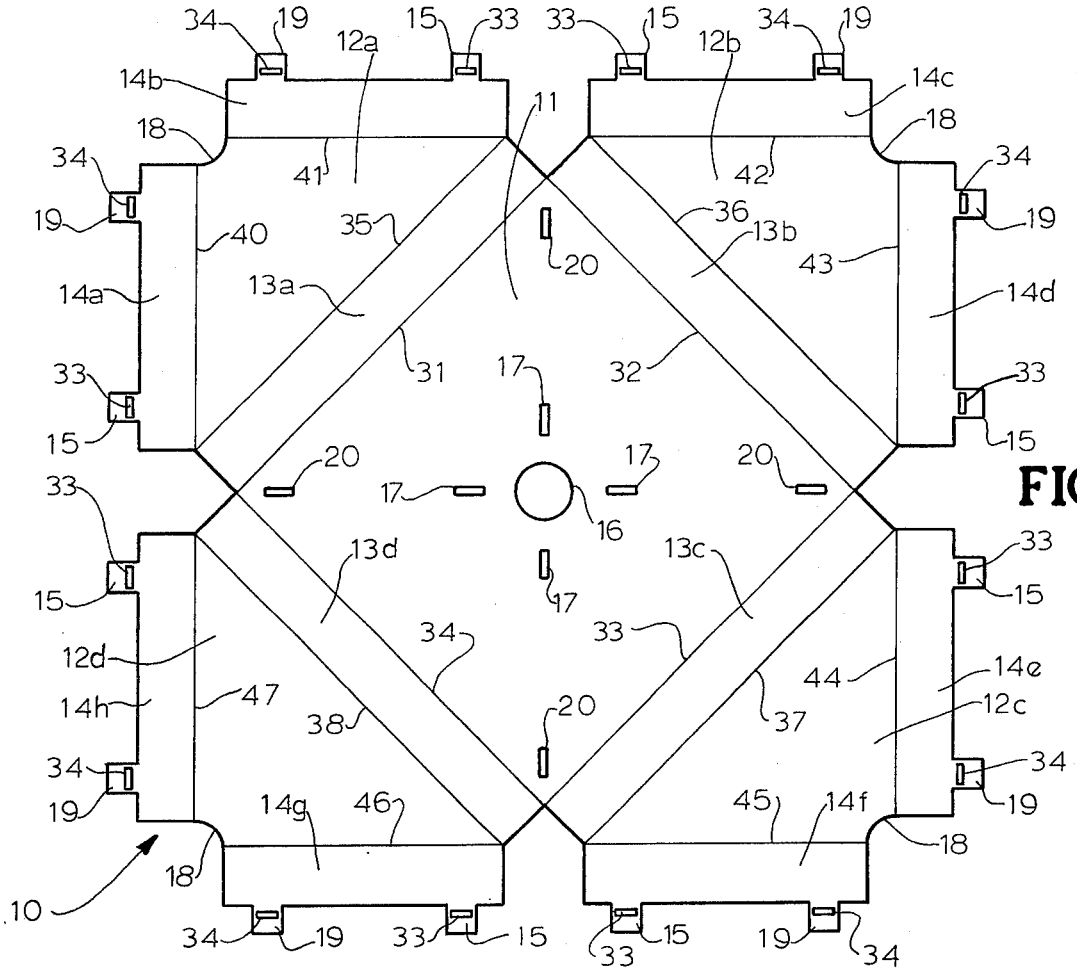
FIG. 1 is a plan view of the blank of material from which the structural frame is made.

Referring to FIG. 1, in the preferred embodiment blank 10 is a flat, die-cut layout of scored corrugated paperboard. A central, square front wall panel 11 has a hole 16 cut in its center and slots 17, 20 cut along its diagonals. Front panel 11 is hingedly connected at score lines 31, 32, 33, 34 to four rectangular sidewall panels 13*a*, 13*b*, 13*c*, 13*d*. The side panels are hingedly connected at score lines 35, 36, 37, 38 to four rear wall panels 12*a*, 12*b*, 12*c*, 12*d* which are shaped like isosceles right triangles. A small, arc-shaped portion 18 of each triangle is cut away at the right angle so that when blank 10 is folded there will be a hole extending through the center which lines up with hole 16.

Eight closure flaps 14*a*, 14*b*, 14*c*, 14*d*, 14*e*, 14*f*, 14*g*, 14*h* are hingedly connected at score lines 40, 41, 42, 43, 44, 45, 46, 47 to the equal sides of the triangular-shaped rear panels. The closure flaps after folding provide inner structural runners along the diagonals of the folded box and lend a great deal of strength to the unit. Two tabs 15, 19 extend from each closure flap. Each tab 15, 19 has a slit 33, 34 for receiving the fingers of the hook strips as later described.

Figure 2:
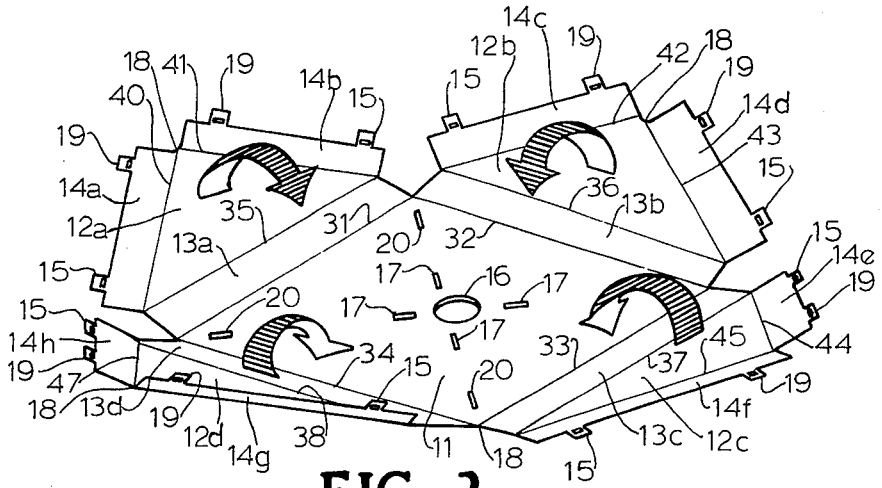
FIG. 2 is a view of the blank showing how it is folded along its score lines to form the structural frame.
Figure 3:
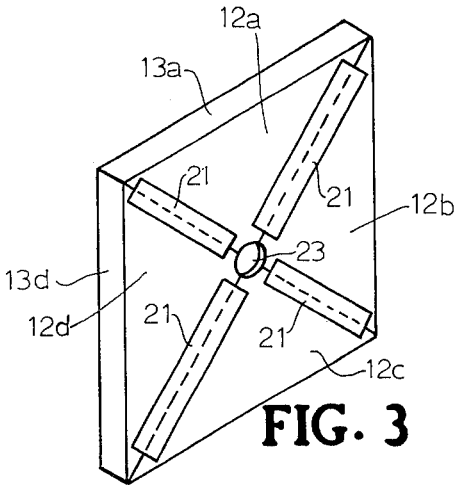
FIG. 3 is an isometric view of the rear side of the structural frame.

FIG. 2 illustrates how blank 10 is folded along the various score lines. Panels 12*a–d*, 13*a–d* and flaps 14*a–h* and flaps 14 are folded along their respective score lines so that two inner tabs 15 fit into each outer slot 20 and two outer tabs 19 fit into each slot 17. When all the quadrants are folded into place with the tabs inserted, the abutting rear panels are taped together by tape 21 so as to form a solid tension skin (FIG. 3). Hole 16 in front panel 11 and the cut-away portions 18 of the rear panels align to form a hole 23 through the entire folded structure.

Figure 4:
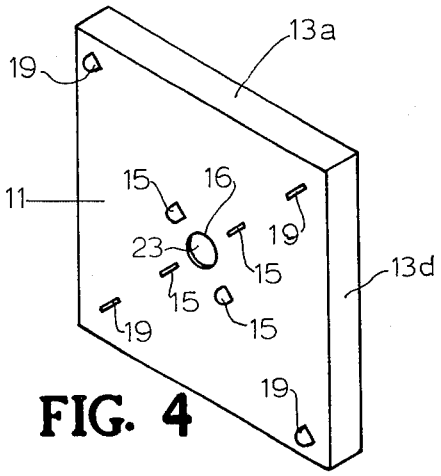
FIG. 4 is an isometric view of the front side of the structural frame.
Figure 5:
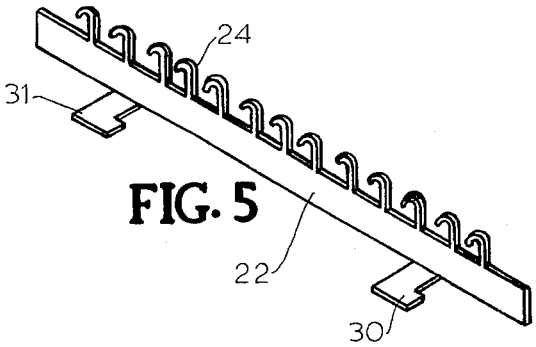
FIG. 5 is an isometric view of a hook strip of the present invention.
Figure 8:
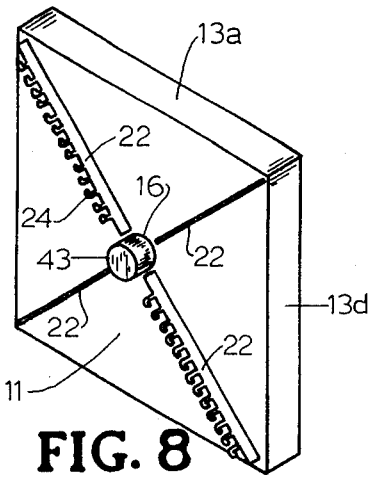
FIG. 8 is an isometric view of the front of the structural frame with the hook strips mounted thereon and with the plug in place.

FIG. 4 illustrates the front of the blank after it has been folded into a structural frame. Two tabs 15 protrude through each slot 20 and two tabs 19 protrude through each slot 17. Referring to FIG. 8, four hook strips 22 extend from hole 16 along the diagonals of front panel 11 to the corners of panel 11. Each hook strip 22 has two fingers 30, 31 which fit into slits 33, 34 in tabs 15, 19 (FIG. 5). Thus, hook strips 22 rest against the upper surfaces of tabs 15, 19 and are held in place by fingers 30, 31. The hook strips also rest against the surface of front panel 11.

Figure 7:
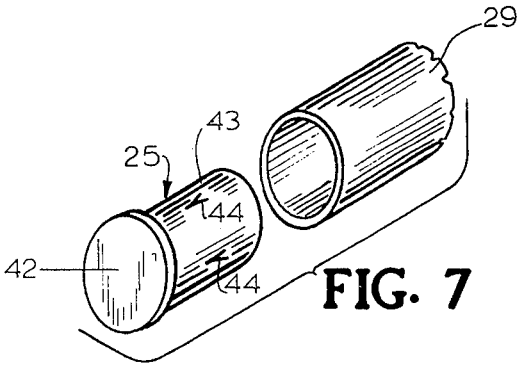
FIG. 7 is an isometric view of a plug which slides through the end assembly and fits into the spreader bar.

FIG. 7 illustrates plug 25 which consists of a head 42 and a shank 43 of smaller diameter than head 42. When the structural frame with hook strips has been assembled, plug 25 which is made of any suitable material is press fit through hole 23 so that it protrudes about 1½ inches on the front side of the assembly.

Two completed assemblies are held in opposed space relation by a conventional tube-type spreader bar 29 which fits tightly over the outer surface of shank 43 of plug 25 and is snared by sharp points 44. The two end assemblies and spreader bar are now adapted to be mounted on a conventional creeling frame for reeling pile fabrics in the manner which is well-known in the art.

Figure 6:
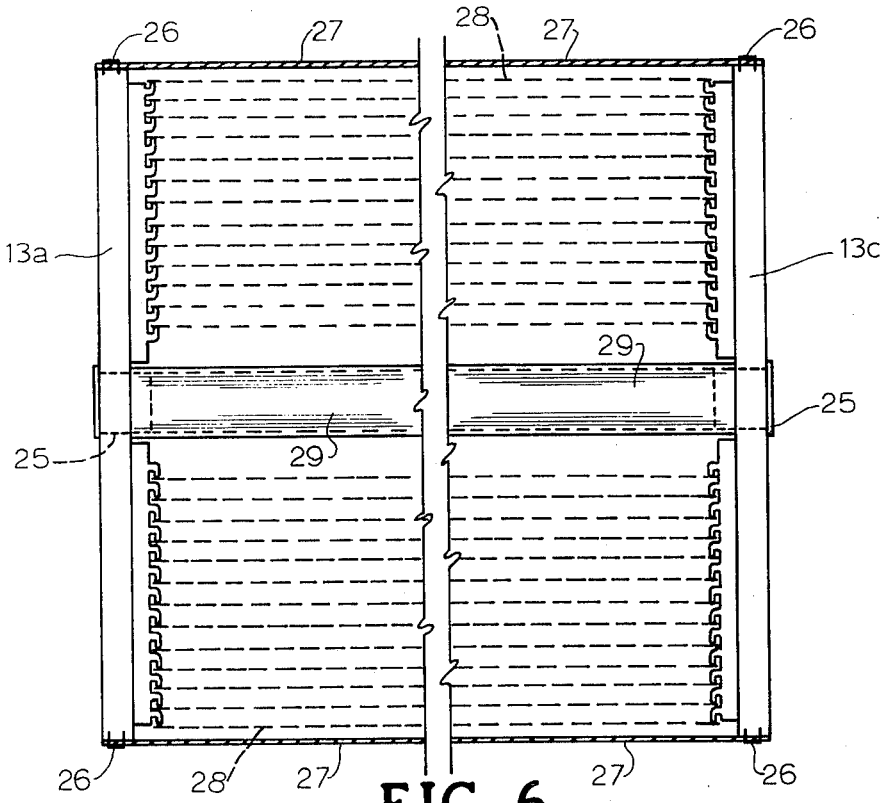
FIG. 6 is a partial section view of two end assemblies connected by a spreader bar and loaded with convolutions of pile fabric.

Once the fabric has been reeled onto the hooks 24, a wrapper 27 is wrapped about the unit and held to the sides of the end assemblies by staples 26 (FIG. 6).

Figure 13:
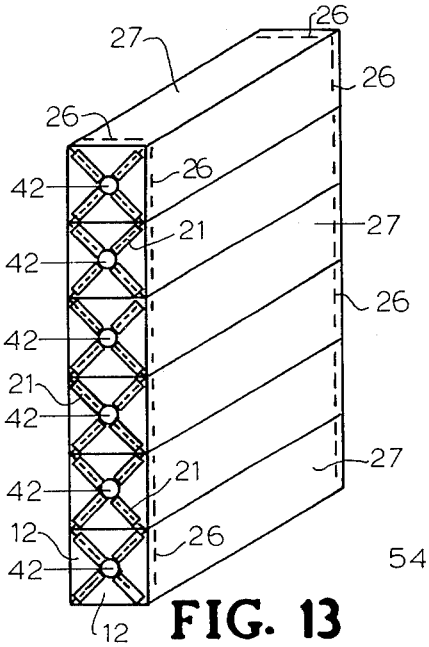
FIG. 13 is a perspective view showing a number of loaded reels stacked for transportation or storage.

When the hook strips are loaded with pile fabrics, the weight of the fabric tends to put the rear surface of the end assembly in tension and the front surface in compression. By taping the rear panels together along the diagonals of the rear surface, the rear surface acts as a solid tension skin. The inner runners along the diagonals of the end assembly formed by the closure flaps enable the assembly to withstand the weight of the fabric and enable the front wall to withstand the compression acting on that surface. The inner runners also provide enough strength to the assembly so that the filled boxes can be stacked as shown in FIG. 13. Quick setting glue, large industrial type stapling, and the like, may be used for securement in lieu of the tape.

Figure 9:
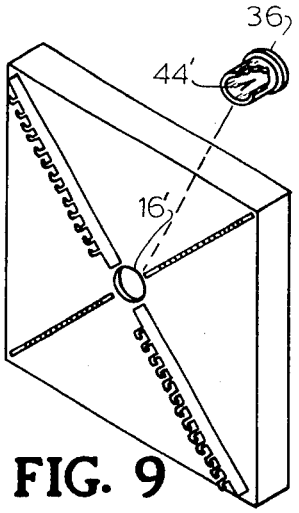
FIG. 9 shows the metal hub of a first alternative embodiment of the invention and in use with the structural frame.

Referring to FIG. 9, in a first alternative embodiment, hole 16' is cut so as to accommodate a hollow metal hub 36. Hub 36 is inserted into hole 16' and has an inside diameter adapted to fit over and frictionally engage the spreader bar to hold it in place. Barb points 44' are provided within hub 36 and engage the exterior surface of the spreader bar.

Figure 10:
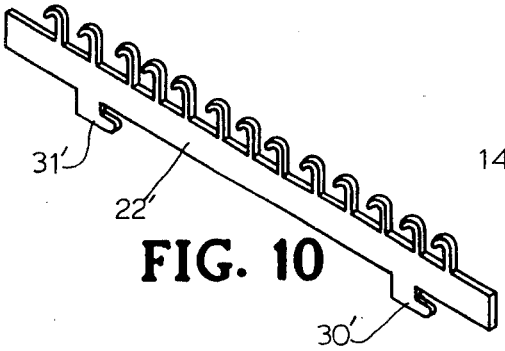
FIG. 10 shows a hook strip of a second alternative embodiment of the invention.

Referring to FIG. 10, in a second alternative embodiment, hook strips 22' have fingers 30' and 31' which are in the same plane as the hooks. Fingers 30' and 31' fit directly into slots 17 and 20 rather than into slits in the tabs. Hook strips 22' are adapted to rest against the upper surface of tabs 15 and 19 and against the surface of front panel 11.

Figure 11:
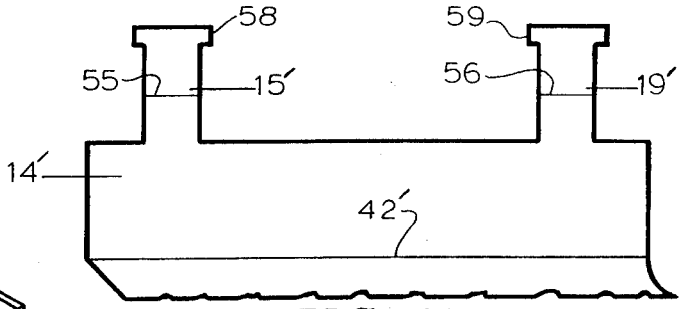
FIG. 11 illustrates the foldable tab feature of a third alternative embodiment.
Figure 12:
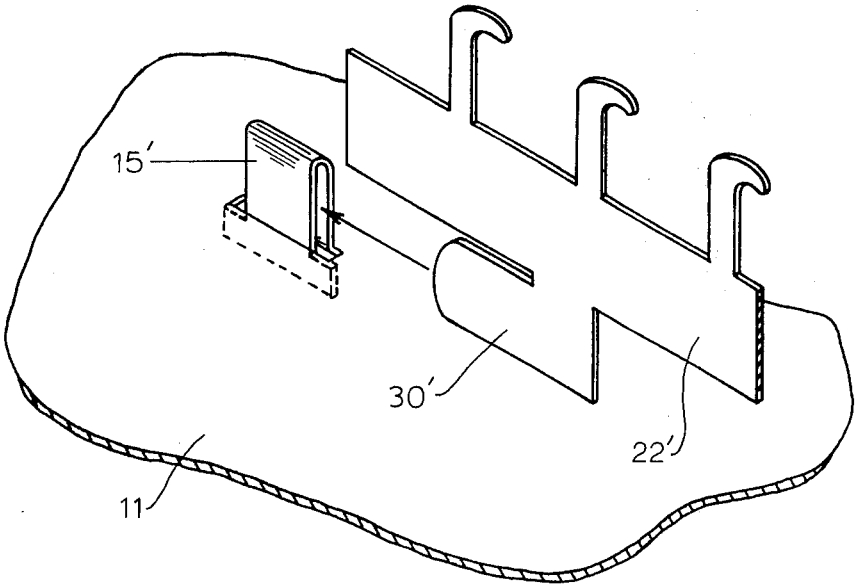
FIG. 12 is an exploded, fragmentary, perspective view of the foldable tabs receiving a hook strip in place.

FIG. 11 illustrates T-shaped foldable tabs 15', 19' of a third alternative embodiment. Tabs 15', 19' are folded along score lines 55, 56 before the tabs are inserted into slots 20, 17 (FIG. 1). T-members 58, 59 on the end of tabs 15', 19' are made larger than slots 20, 17 so that the T-members 58, 59 cannot slip through the slots. Only one foldable tab is inserted into each slot. Thus, there are only eight foldable tabs instead of 16. FIG. 12 shows how the foldable tabs hold hook strips 22' (FIG. 10) in place. Fingers 30', 31' slip inside the folded tab to hold the hook strips 22' in place.

Once the hook strips are loaded with pile fabric, the resultant force on each hook strip is directed essentially along the length of the hook strip, i.e., along the diagonals of the end assembly. In each embodiment described above, this resultant force tends to securely hold the fingers of the hook strips in their mating openings.

Figure 14:
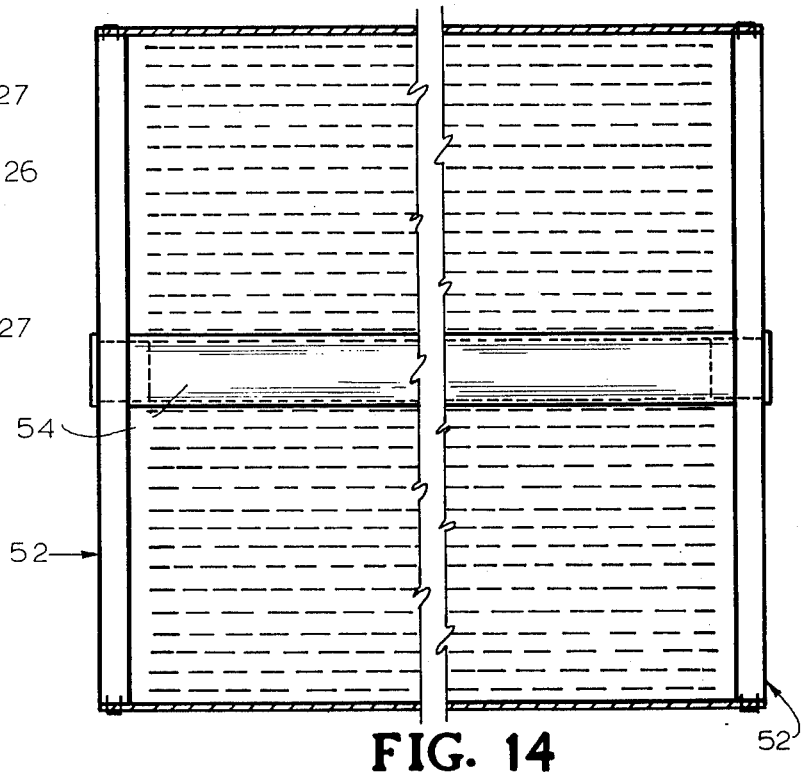
FIG. 14 is a partial section view of a reel having carpet or fabric wound directly onto the spreader bar without the use of hook strips but using the invention's structural frame.

FIG. 14 shows a box containing carpet or fabric which is wound directly onto a spreader bar 54 without the use of hook strips. Such a construction requires a strong end piece which may be supplied by a fold-up end assembly 52 made according to the invention but with the tabs made with no projections or taped flat to the front side of the assembly as required.

Figure 15:
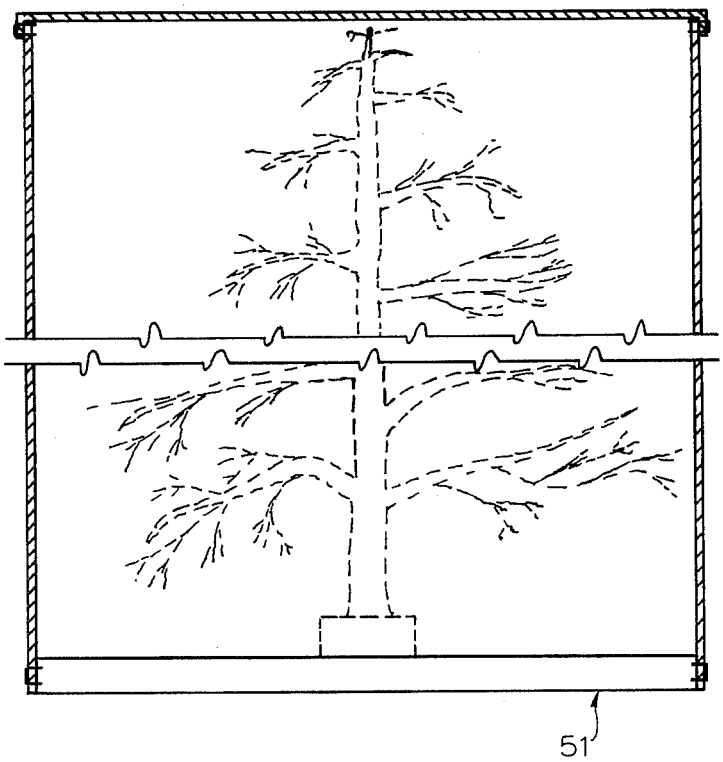
FIG. 15 shows a box having a fold-up base member formed by a structural frame according to the invention for supporting an item which needs base support.

FIG. 15 illustrates a box holding an item which needs base support as another application. Such support is given by a fold-up end assembly 51 made according to the invention but without the central hole for spreader bar support and with the tabs formed with no projections or taped as previously described.

The invention provides an extremely strong end assembly which requires no riveting or welding of metal parts. The blank paperboard is die-cut and scored at the factory and shipped directly to the customer. The shipping costs are substantially lower than those of conventional end assemblies because the blanks can be stacked with no lost space. The hook strips are stamped from metal, rigid plastic, or the like, and can be shipped to the customer independent of the blanks. It can be seen that the manufacturer has no expense of assembly. The customer assembles the unit himself. Experience has shown that customers for such a product are willing to assemble them in order to save on the initial cost of these high quantity units.

Once the assembly has been used, the metal hook strips can be easily removed and returned to the manufacturer for credit and subsequent reuse. Another advantage of the invention is that the back surface of the assembly presents a neat appearance so that when pile fabric is rolled onto one of the assemblies, there is no need to insert the entire unit into a box with flaps. A simple wrapper of light weight paper can be wrapped around the fabric and stapled to the edges of the end assemblies. Because of the strength of the end assemblies, the loaded reels can be stacked as shown in FIG. 13.

Scored corrugated paperboard, stiff paperboard, scored plastic sheet, and the like, are all deemed suitable for the end assembly of the invention when of suitable strength and rigidity for the particular applications. The spreader bar, when needed, may be of compressed paper, metal, or the like.

While illustrated only in connection with pile fabric, the creel of the invention is recognized as being useful for other coiled web or sheet materials in continuous lengths such as wallpaper, wrapping paper, scrim, film, decorative fabrics, and the like. In many such applications, the particular web or film does not require separation as with pile fabric. Thus, hook strips or other spacing means are not required. However, the many advantages of being able to ship the structural end pieces flat for assembly at the point of use are still obtained in such applications.

What is claimed is:

1. A creel for pile fabrics, and the like, comprising, in combination:

a. two box-like structural end members folded into structural form from blanks of foldable sheet material with each end member having a rectangular rear tension panel spaced from, integrally connected to and disposed opposite and parallel to a rectangular front compression panel of similar size;

b. a set of plural hook strips for each end member, said strips having hooks for receiving convolutions of pile fabric and the like, and each set of strips being secured in a radial arrangement, with the inner ends thereof spaced, on a respective outer front panel surface of a said end member;

c. a spreader arm; and d. means for securing the ends of said spreader arm to said end members to hold said end members in spaced relation with said front panels opposed.

2. The creel of claim 1 wherein the front panels of said end members provide slots along the diagonals thereof and said hook strips have fingers extending therefrom adapted to fit within said slots when secured to the respective said front panels.

3. The creel of claim 2 wherein said blanks comprise prescored paperboard materials.

4. A creel as claimed in claim 1, a. wherein each said end member in said folded form includes a central opening extending through said front and rear panels;

b. wherein said securing means include a pair of tubular shaped holding means adapted to being press fitted in said openings; and c. wherein the ends of said spreader arm are adapted to engage said holding means.

5. The creel of claim 4 wherein said holding means comprise tubular plugs adapted to protrude from the respective front panels of said end members when installed and wherein said spreader arm is tubular and the ends thereof are adapted to frictionally engage the external surfaces of said plugs.

6. The creel of claim 4 wherein said holding means comprise tubular cylinder means adapted to protrude from the respective front panels when installed and wherein said spreader arm is tubular and the ends thereof are adapted to being frictionally engaged within said tubular cylinder means.

7. A blank construction of foldable sheet material having score lines arranged for folding the blank into a structural member, comprising:

a. a central, substantially square, front wall panel;

b. four substantially rectangular sidewall panels, each being hingedly connected on a score line along one of its longer sides to a corresponding edge of the front wall panel, and having a width approximately equal to the thickness of the structural member when folded;

c. four rear wall panels, one of which is hingedly connected on a score line to each of said sidewall panels, said rear wall panels being substantially isosceles right triangles with the hypotenuse thereof forming the hinged connection with the sidewall panels; and d. a plurality of substantially rectangular closure flaps connected on score lines to the equilateral sides of said rear wall panels; and e. means for retaining said structural member in box-like form after folding, whereby said blank construction is folded along each of said score lines into a structural, box-like member of rectangular cross-section having inner structural runners along the diagonals thereof formed by said closure flaps.

8. The construction of claim 7 wherein said foldable sheet material is paperboard material.

9. The blank construction of claim 7 in which said front wall panel has a hole cut in the center thereof and each of said rear wall panels has a cut-away portion at the apex of each triangle so as to provide a hole in the rear wall after folding which lines up with said hole in the front wall, thereby providing a hole through said structural member for receiving cylindrical tubes, plugs, and the like, by press fit.

10. The blank construction of claim 7 in which said means for retaining said structural member in box-like form comprises tape strips secured to the outer rear wall panels along the diagonals of said structural member thereby adapting said rear wall panels for service as an integral tension surface.

11. The blank construction of claim 7 in which said front wall panel has a selected number of slots along the diagonals thereof and said closure flaps have integral tabs extending from their outer edges with said tabs being adapted to slip through said slots in said front wall panel after folding.

12. The blank construction of claim 11 wherein said tabs have slits cut therein for receiving hook strips of a type adapted to receive convolutions of pile fabric, and the like.

13. A reel for creeling continuous lengths of coiled film, sheet, web, and like materials, comprising, in combination:

a. a pair of structural end members, each said end member being formed from a blank of folded sheet material and secured into a box-like form having oppositely spaced parallel front and rear panels of similar size;

b. a spreader arm; and c. means for securing the ends of said spreader arm to the respective central portion of each said end member to hold said end members in spaced relation with said front panels opposed to provide for coiling of such material around said arm and between said members.

14. The reel of claim 13 wherein said members box-like form provides for each said end member rectangular, front and rear panels adapted respectively for being compressed and tensioned when said creel is loaded with said material.

15. The reel of claim 14 including plural radial hook strips secured to the respective front panel of each said end member and adapted to receive the material thereon.

16. The creel of claim 1 including a wrapper formed from sheet wrapping material and extending between said panels to serve as a cover for the pile fabric, or the like, after reeling, said sheet wrapping material being secured at each end of said creel to respective outer peripheral edge portions between the respective panels of the respective said end members.

* * * * *

UNITED STATES PATENT OFFICE

CERTIFICATE OF CORRECTION

Patent No. 3,989,203 Dated November 2, 1976

Inventor(s) Clarence Orville Williams

It is certified that error appears in the above-identified patent and that said Letters Patent are hereby corrected as shown below:

Col. 2, line 62, "and flaps 14" should be deleted.

Signed and Sealed this

Eighth Day of February 1977

[SEAL]

*Attest:*

RUTH C. MASON
*Attesting Officer*

C. MARSHALL DANN
*Commissioner of Patents and Trademarks*